United States Patent [19]

Fisher

[11] Patent Number: 4,501,093

[45] Date of Patent: Feb. 26, 1985

[54] PROFILE MACHINING APPARATUS

[75] Inventor: Allan J. Fisher, Cambridge, England

[73] Assignee: The Newall Engineering Company Limited, Peterborough, England

[21] Appl. No.: 449,565

[22] Filed: Dec. 13, 1982

[30] Foreign Application Priority Data

Jun. 21, 1982 [GB] United Kingdom ..... 8217890

[51] Int. Cl.[3] ..... B29B 49/00

[52] U.S. Cl. ..... 51/165.71; 51/97 NC

[58] Field of Search ..... 51/97 NL, 101 R, 165.71, 51/165 TP, 165 R, 165.93

[56] References Cited

U.S. PATENT DOCUMENTS

| | | | |
|---|---|---|---|
| 3,943,664 | 3/1976 | Broide | 51/101 R |
| 3,970,830 | 7/1976 | White | 51/165.71 |
| 4,027,245 | 5/1977 | Bourrat | 51/165.71 |
| 4,074,467 | 2/1978 | Robillard | 51/165.93 |
| 4,371,941 | 2/1983 | Gordiski | 51/165.71 |
| 4,400,781 | 8/1983 | Hotta | 51/97 NC |

*Primary Examiner*—Harold D. Whitehead

*Attorney, Agent, or Firm*—Watson, Cole, Grindle & Watson

[57] ABSTRACT

The disclosure relates to a profile forming apparatus and in particular a cam grinding machine in which a cam to be ground is mounted for rotation about the axis of the cam shaft in a work-table and a drive motor rotates the cam about its axis at a speed controlled by a predetermined programme. The work-table is mounted for rocking movement about an axis parallel to the cam shaft axis to move towards and away from the rotating grinding wheel which grinds cam surfaces spaced apart along the camshaft. The work-table is driven positively about its axis by a reversible drive motor in accordance with a further programme to rock the camshaft towards and away from the axis of the grinding wheel as the camshaft rotates and thereby determine the shape and dimensions of the profile to which the cam is ground.

14 Claims, 5 Drawing Figures

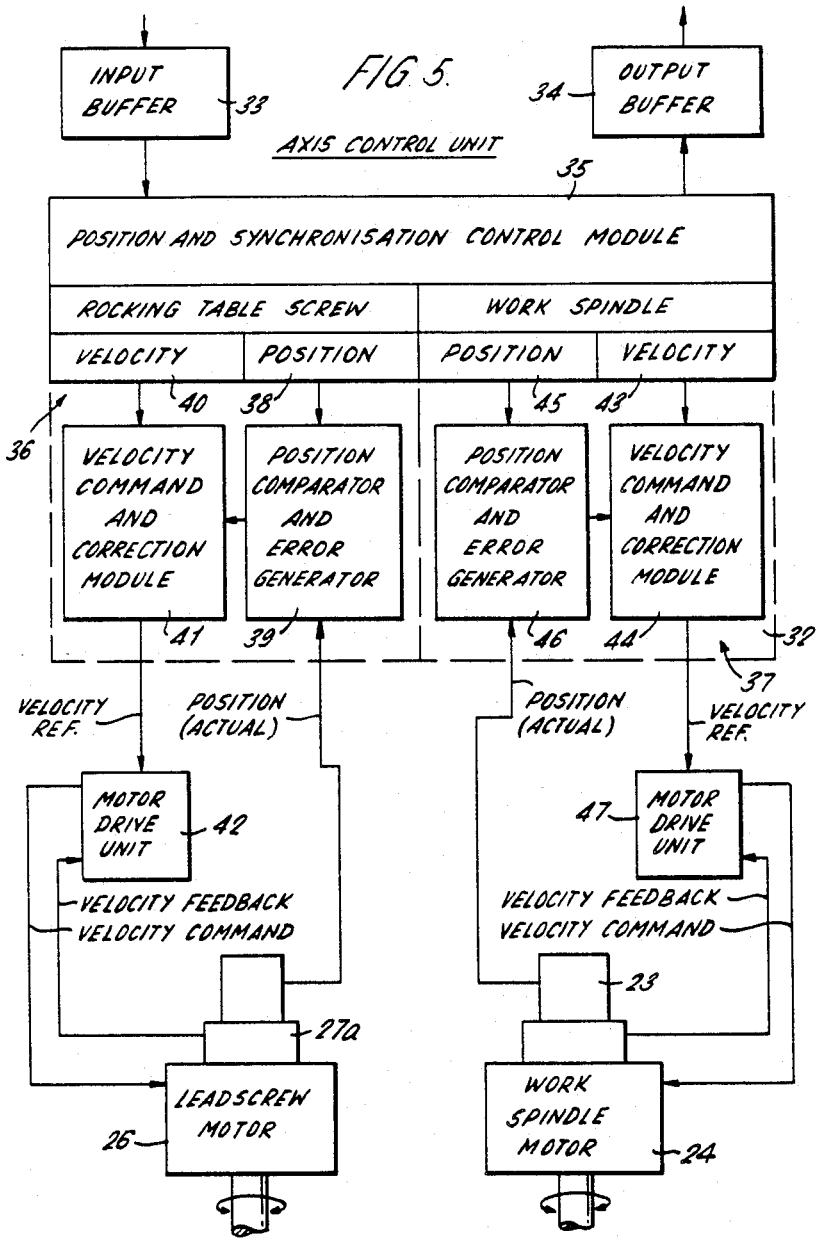
FIG. 5.
AXIS CONTROL UNIT
INPUT BUFFER
33
OUTPUT BUFFER
34
35
POSITION AND SYNCHRONISATION CONTROL MODULE
ROCKING TABLE SCREW
WORK SPINDLE
VELOCITY
POSITION
POSITION
VELOCITY
40
38
45
43
36
VELOCITY COMMAND AND CORRECTION MODULE
POSITION COMPARATOR AND ERROR GENERATOR
POSITION COMPARATOR AND ERROR GENERATOR
VELOCITY COMMAND AND CORRECTION MODULE
41
39
46
44
32
37
VELOCITY REF.
POSITION (ACTUAL)
POSITION (ACTUAL)
VELOCITY REF.
MOTOR DRIVE UNIT
42
47
MOTOR DRIVE UNIT
VELOCITY FEEDBACK
VELOCITY COMMAND
VELOCITY FEEDBACK
VELOCITY COMMAND
23
27a
LEADSCREW MOTOR
26
WORK SPINDLE MOTOR
24

PROFILE MACHINING APPARATUS

BACKGROUND OF THE INVENTION

1. Field of the Invention

This invention relates to profile machining apparatus and is particularly although not exclusively applicable to apparatus for machining cam profiles.

2. Description of the Prior Art

Examples of apparatus for machining cam profiles include grinding machines in which a work table carries a motor driven master cam and a component cam axially aligned with and coupled to the master cam to rotate therewith. The work table is arranged to pivot about an axis parallel to the axis of rotation of the master cam. A grinding wheel is driven about an axis parallel to the axis of rotation of the master cam and component to act on a surface of the component cam and a cam follower is mounted with the surface of the follower in fixed relation to the surface of the grinding wheel to engage the master cam. Normally the distance between the pivot axis of the work table and the periphery of the cam follower is arranged so that when the master cam contacts the cam follower at the minimum lift part of the master cam form, that is the base circle, then the axis of rotation of the master cam lies in the plane containing the grinding wheel axis of rotation and contact point between the cam follower and master cam. The rocking table is biased to engage the master cam with the cam follower and the ground profile on the component cam is generated by the rocking motion of the work table as the master cam is caused to rotate whilst in contact with the cam follower. The profile of the ground cam is related to that of the master cam by the following relationships of the generating mechanism;

1. The distance between the axis of rotation of the master cam and the table pivot axis;

2. The distance between the centre distances of the cam follower and wheel relative to the pivot axis;

3. The ratio between the radii of the cam follower and the grinding wheel.

The cam grinding apparatus outlined above has the following disadvantages:

i. The ground work cam profile changes as the grinding wheel radius changes;

ii. One or more master cam forms are required for each work cam to be ground on the component;

iii. The cam follower must be re-positioned on to the correct cam form on the master cam bank as the work table is indexed laterally to the next cam on the cam component.

iv. Each cam form is generated from a different master. That is although the component may have sets of identical forms (e.g. inlet and exhaust cams) each individual cam will be ground from a different master.

v. The cam lift data is stored in the form of machine master cams mounted integrally on the master bank. They are therefore:

1 difficult to modify 2 prone to damage and wear 3 expensive to produce 4 expensive to service/repair.

vi. The master cam forms must be produced on a machine having identical geometry to the machine on which they are to be used.

vii. Although the master cam banks can be interchanged in order that different component cam shafts can be ground on the same machine, such re-tooling is time consuming and to a great extent limits the flexibility of the machine.

viii. It is virtually impossible to modify the phase relationships between each individual cam on the master cam bank. Such adjustments inevitably require a new master cam bank.

ix. The drive motor is required to rotate both the master cam bank and component cam shaft and also to provide the force for locking the work table against the action of the biasing means as the master cam moves over the cam follower. The motor is required to rotate at varying speeds in order to provide a substantially constant rubbing speed between the grinding wheel and workpiece and at the same time is required to cope with large torque variations in order to cause the rocking of the work table. This latter requirement is especially significant since high contact pressures are required between the master cam and cam follower in order to meet the normal grinding forces.

x. The machine alignments have to be very closely maintained during manufacture and assembly so that master cams can be replaced or inter-changed. Small variations in the generating mechanism geometry between the machine on which the master cam was produced and the machine on which it is to be used will cause significant errors in the forms of the ground component cam.

Recent developments in computer technology have made it possible to generate cam forms from master cam data stored in a computer memory. This eliminates the requirement for a machined master cam bank and the difficulties which arise from the use of the master cam bank as outlined above. Current applications of computers to grinding machines have been for conventional grinding machines adapted to be controlled by the computer so that the wheel head motion is synchronised with the work rotation allowing non-circular profiles to be ground. The angular displacement and velocity of the work and the linear displacement of velocity of the wheel head are maintained by servomechanisms under the control of a micro-processor. However, due to the high velocity and acceleration rate required during cam generation and the large masses and inertias involved (that is the wheel head assembly and feed screw), rotational speed of the work is limited by the response of the control systems (the linear acceleration of the wheel head being proportional to the square of the work rotation speed). Such system have the complication that the grinding feeds and rates must be superimposed on the cam generation motion.

SUMMARY OF THE INVENTION

This invention provides a profile forming apparatus comprising means for rotatably mounting a workpiece whilst a profile is to be formed thereon. Drive means for rotating the workpiece at a speed determined by a predetermined programme, a rotary machine tool for moving stock from a portion of the workpiece held by the mounting means, the machine tool being rotatable about an axis parallel to the axis of rotation of the workpiece, means for supporting said mounting means for rocking movement about an axis parallel to the axis of rotation of the workpiece, means to feed in the grinding wheel at a predetermined rate and by a predetermined distance to remove a required amount of stock from the workpiece and reversible drive means for rocking the mounting means in accordance with the predetermined programme to determine the dimensions and shape of the profiles to be machined on the workpiece by the machine tool.

This arrangement effectively separates the cam generating control function from the grinding wheel feed cycle control function and enables the inertia of that part of the apparatus which moves to vary the shape of the profile being machined on the workpiece to be minimised and therefore enables the mechanism to have a high speed of response to changes dictated by the programme.

The predetermined programmes for controlling the drive motor for the workpiece and reversible drive means for rocking the work table may be contained in a microprocessor system connected to the drive motor and reversible drive means to control the operation thereof.

The microprocessor unit may include memory means having a first file for storing polar co-ordinate information for each shape to be generated; a second file for apparatus constants relating to the generated geometry of the apparatus and a third file for component velocity information and profile selection from the profiles stored in the first file.

More specifically, the microprocessor unit may be connected through a control unit to the workpiece drive motor and to the reversible drive means for the work table, the control means for the work table drive means comprising velocity control means for the reversible drive to receive velocity/position signals from the microprocessor of the required velocity and position and for detecting the actual position of the drive means to dictate the appropriate velocity to the drive means and means for controlling the velocity of workpiece drive motor in accordance with the position and velocity of the signals received from the microprocessor and the actual position of the workpiece to dictate the appropriate velocity to the drive motor.

BRIEF DESCRIPTION OF THE DRAWINGS

FIG. 5 is a diagrammatic view of a control system for the grinding machine.

DESCRIPTION OF THE PREFERRED EMBODIMENTS

Figure 1:
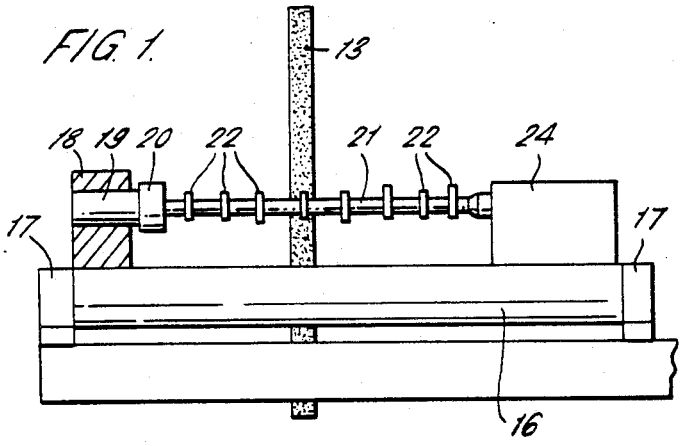
FIG. 1 is a side elevation of a grinding machine for grinding motor vehicle engine cam shafts.
Figure 2:
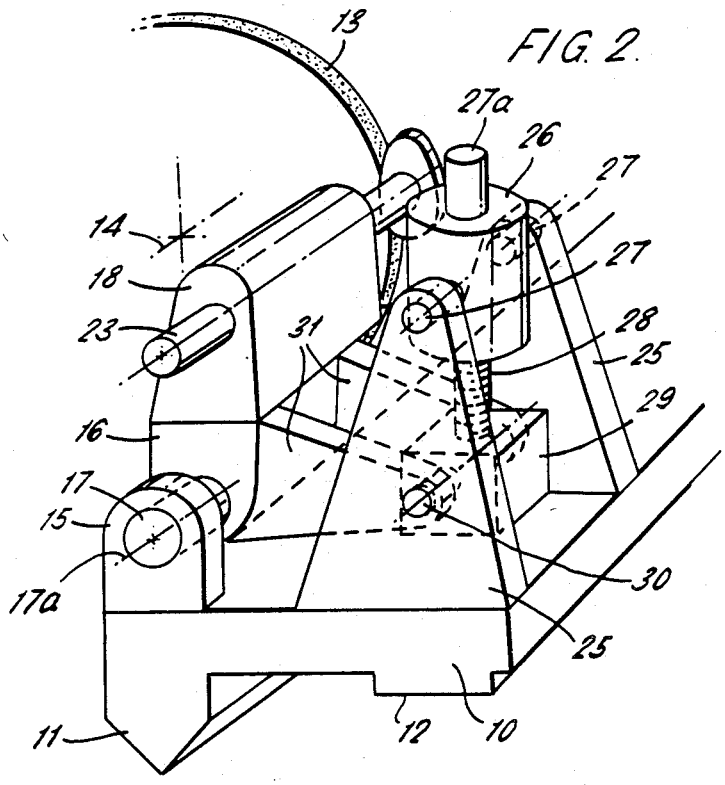
FIG. 2 is a perspective view of an end part of the grinding machine of FIG. 1.

Referring firstly to FIGS. 1 to 4 of the drawings, there is shown a machine for grinding motor vehicle engine cam shafts. The machine comprises a machine base 5 on which a bottom table 10 is mounted. The machine base has a horizontal flat bearing surface 6 extending lengthwise of the base adjacent the forward side of the base and a V-section slideway 7 extending lengthwise along the base adjacent the rearward side of the base. The table 10 has a downwardly extending V-section slide 11 at the rearward side thereof to engage in the slideway 7 and a downwardly facing flat bearing face 12 to engage on the bearing face 6 on the base. The table is thus supported for linear sliding movement along the base. A lead screw is mounted on the base 5 on the centre line 8 disposed between the bearing surface 6 and slideway 7. The lead screw is driven by a D.C. servo motor (not shown) and engages in a nut (also not shown) mounted on the table 10. The D.C. servo motor has a position and rate transducer (not shown) connected to a micro-processor which controls the movement of the table along the base and thereby present different parts along a workpiece supported on the table for grinding at a grinding station indicated at 9. The micro-processor hereafter referred to as the cycle control micro-processor controls other functions of the machine described later and operates with two further micro-processors for controlling the cam generation function of the machine under control of a programmed logic controller for governing operation of the machine as a whole. At the grinding station a large diameter conventional grinding wheel 13 is mounted on the rearward side of the base to rotate about an axis 14 extending in true parallelism with the direction of movement of table 10 on the base to act on a workpiece supported on the table. The operation of the grinding wheel will be described in greater detail later.

The table has two upstanding pivot blocks 15 at opposite ends thereof in which co-axial bearings (not shown) are supported. A rocking table 16 extends the length of the bottom table between the lugs 15 and is formed with protecting stub shafts 17 which are received in the bearings supported in the lugs to mount the rocking table for pivotal movement about an axis **17*a* in true parallelism with the grinding wheel axis 14 and direction of movement of the table 10. The rocking table 16 carries, at one end, a work head assembly 18 having a work spindle 19 (see FIG. 1) having a collet 20 to receive and support one end of a motor vehicle cam shaft 21 having spaced cam elements 22 thereon to be ground. The work head assembly 18 also encloses a variable speed D.C. servo motor for rotating the work spindle at a speed in accordance with the control system as described later. Projecting from the work head assembly 18 on the opposite side to the drive spindle is a work spindle position/rate transducer which is coupled to the work spindle and measures the angular displacement and velocity of the work spindle. The other end of the cam shaft 21 is supported in a conventional tailstock 24** mounted at the other end of the rocking table to support the cam shaft with its axis in true parallelism with the axis of turning of the rocking table and the axis of rotation of the grinding wheel.

At the front end of the bottom table 10 opposite the work head assembly 18 two generally triangular upstanding spaced lugs 25 are mounted and a variable speed reversible electric drive motor 26 is mounted in trunnions 27 at the apices of the lugs to swing between the lugs. The drive motor has a ball screw output drive 28 extending downwardly from the motor and a ball screw position/rate transducer **27*a* extends from the upper side of the motor coupled to the ball screw of the motor to measure the angular displacement and velocity of the ball screw. The ball screw engages in a ball screw nut 29 having trunnions 30 projecting at either end thereof to support the nut for pivotal movement between the apices of a pair of laterally extending lugs or levers 31 mounted on the rocking table 16. Thus rotation of the motor in either direction and in accordance with the control system to be described later rocks the table 16 about the axis 17*a* of the table and thereby moves the cam shaft supported on the rocking table towards and away from the peripheral surface of the grinding wheel 13**.

Figure 3:
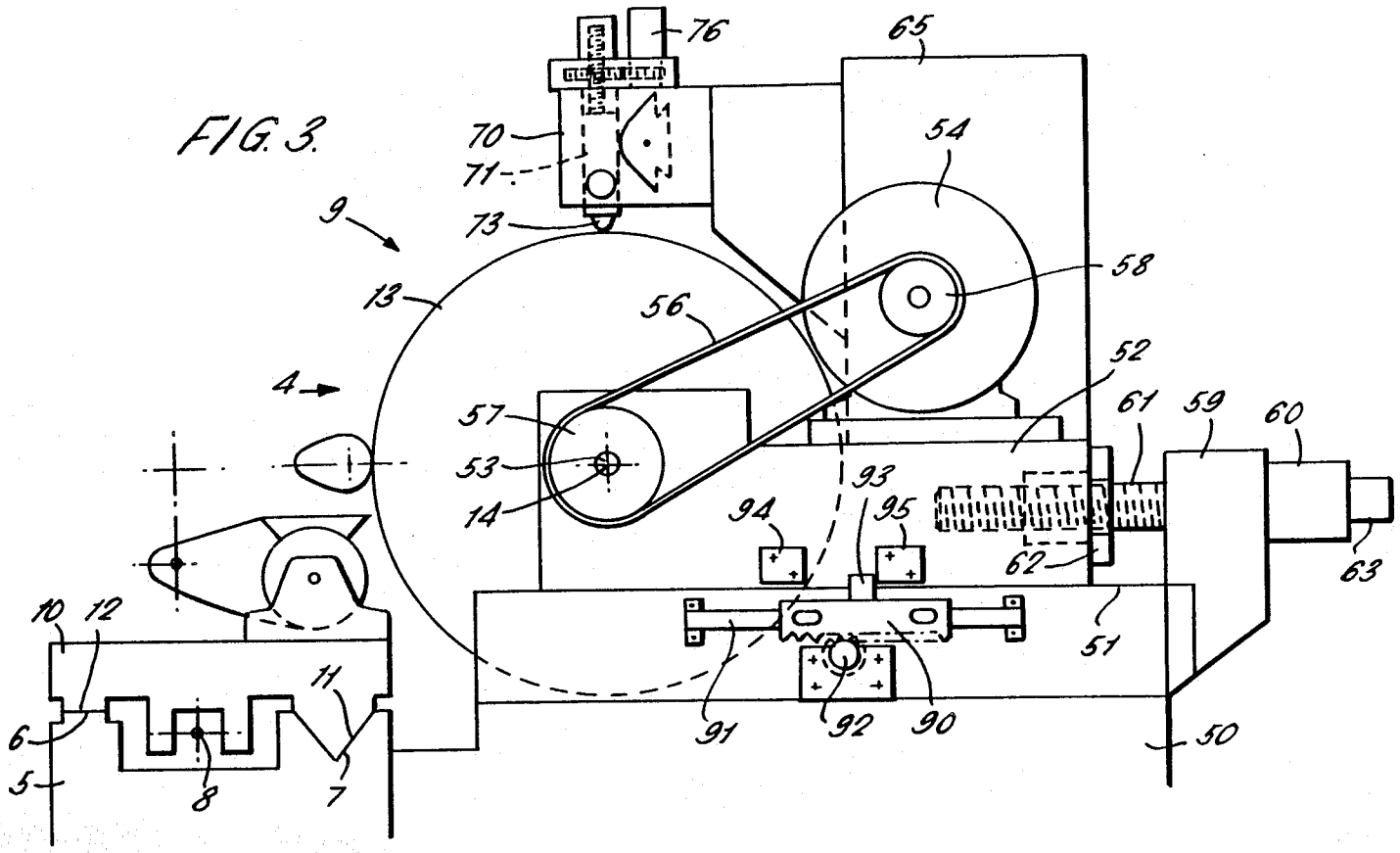
FIG. 3 is an end view of the grinding machine.
Figure 4:
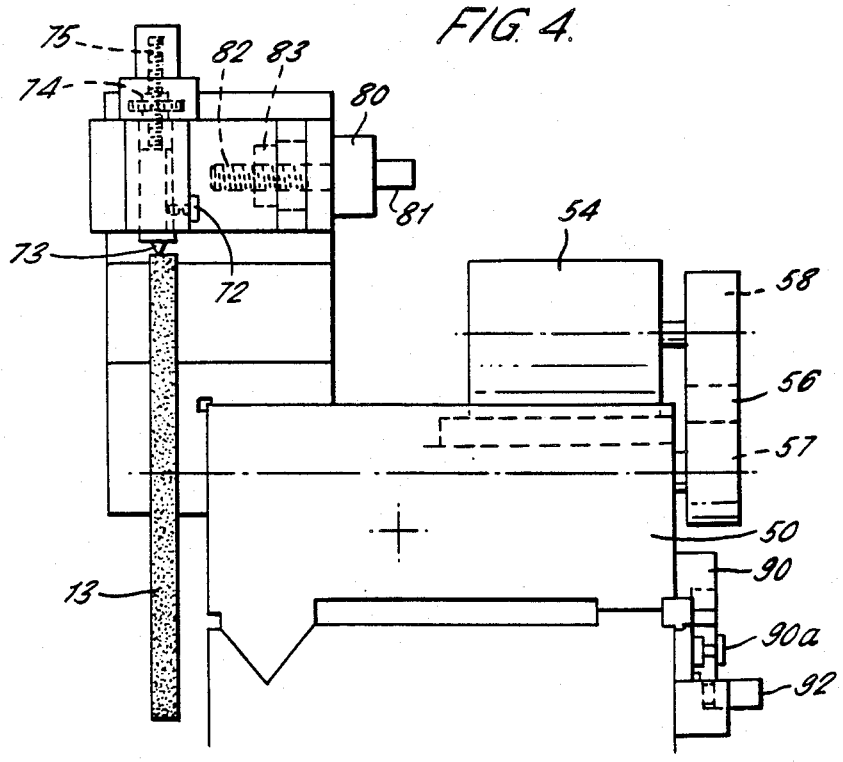
FIG. 4 is a view looking in the direction of the arrow 4 on FIG. 3.

Reference will not be made to FIGS. 3 and 4 of the drawings which show the grinding wheel head assembly. The machine base 5 has a rearward extension 50 on which there is formed a slideway 51 extending transversely to the direction of movement of the bottom table along the machine base. A wheel head slide 52 is mounted on the slideway and a spindle 53 is mounted on the wheel head at the end adjacent the work table and the grinding wheel 13 is mounted on the spindle. An electric drive motor 54 is mounted at the rearward end of the wheel head and a belt drive 56 connects pulleys 57 and 58 on the spindle and motor drive shaft.

At the rearward end of the base extension 50 there is an upstanding thrust housing 59 on which a D.C. servo drive motor 60 is mounted for driving a "ball type" lead screw 61. The lead screw engages in a "ball screw" type nut 62 mounted on the wheel head so that rotation of the lead screw by the motor 60 traverses the wheel head on its slideway towards and away from the workpiece mounted on the work table. The drive motor 60 has a position and rate transducer 63 connected to the cycle control micro-processor which controls the movement of the wheel head as described above thereby providing control of the feed rate of the wheel to cause stock to be removed from the workpiece at the required rate and to the required depth.

Also mounted on the wheel head 52 is a grinding wheel dresser supporting casting 65 which extends over the top of the grinding wheel and provides a mounting for a slide 70 movable transversely parallel to the axis 14 of rotation of the grinding wheel. A vertically extending dresser quill 71 is mounted on the slide and a key 72 on the slide prevents rotation of the quill. The lower end of the quill carries a diamond dressing tool 73 for acting on the upper surface of the periphery of the grinding wheel 13. The dresser quill is displaced vertically by means of a feed screw nut 74 of the ball screw type in which a lead screw 75 engages. The screw 75 is driven by a stepping motor 76 having an encoder connected to a control system for the motor which operates within the cycle control micro-processor.

The slide 70 for the dresser assembly is displaced along its slideway on the dresser casting 65 by a stepping motor 80 having an encoder 81 connected to a control system. The stepping motor drives a lead screw 82 of the ball screw type which engages in a nut 83 of the ball screw type mounted on the slide 70.

The grinding wheel size is established as follows:

i. The dresser quill feed screw is set to a datum with the diamond tool at a known distance from the wheel centre line;

ii. All subsequent movement of the dresser quill from the datum is stored in the dresser control system;

iii. As the diamond feeds down and dresses the wheel, the current wheel size is determined by the datum to current position distance.

The wheel size thus eatablished is fed to a master cam generator of the machine as described later.

In an alternative arrangement the grinding wheel size is determined from the wheel head position.

The wheel size measuring unit comprises a sliding rack 90 which is mounted on a fixed bar 91 on the base extension 50 and has a friction lock 90*a* to provide resistance to free sliding along the bar. Movement of the rack along the bar is measured by a rotary transducer 92 which is attached to a gear in mesh with the rack. The rack has an upstanding post 93 which locates between forward and rearward datum blocks 94, 95 mounted on the adjacent side of the wheel head 52. When the wheel head advances, the rear datum block 95 contacts the post 93 and causes the rack to move forwards. When the wheel head retracts, the front datum block 94 contacts the post 93 and moves the rack rearwardly if the distance the wheel head is retracted exceeds the distance by which it has advanced. Thus for an initial fore position of the wheel head (that is a component ground a size with maximum wheel diameter) the wheel size measuring unit can be provided with a datum. If the wheel diameter is subsequently decreased following dressing, the wheel head will need to move forward a greater distance in order to grind the component to size and the rear datum block will cause the sliding rack 90 to be moved forward also. The forward movement of the sliding rack is measured by the transducer and is directly proportioned to the reduction in wheel size. Since the wheel head retract distance is constant, the front datum block will not move the sliding rack back. Therefore the size of the grinding wheel is established from the initial wheel size at datum and the current rack displacement as measured by the transducer. The wheel size is fed to a master cam generator micro-processor control system of the machine as described later.

The control system for the rocking table motor 26 and wheel head motor 18 will now be described with reference to FIG. 5.

The system uses two micro-processors that is (a) an axis control unit (ACU) and (b) a master cam generator (MCG).

The axis control unit will be described first. The ACU controls the motion (displacement and velocity) of the work spindle 19 and ball screw 28 via DC servo controlled motors as described above. The control data for the motors is held in a memory and relates to the displacement of the component (relative to the grinding wheel) to the incremental angular displacement of the work spindle through one complete revolution. Each data record represents one increment of rotation of the work spindle and contains the following information:

1. Angular position of work spindle from datum
2. Angular velocity of work spindle
3. Displacement of rocking table from datum, measured along axis of lead screw.
4. Displacement velocity of rocking table measured along axis of lead screw.

The axis control unit is referenced 32 in FIG. 3 and has an input buffer 33 and an output buffer 34 for communicating with the master cam generator. The axis control unit has a position and synchronisation control module 35 and separate control modules indicated at 36 and 37 for the rocking table ball screw and work spindle respectively. The control module for the rocking table ball screw comprises a position module 38 connected to a position comparator and error generator 39 and a velocity module 40 connected to a velocity command and correction module 41. Th position comparator and error generator has a further input from the ball screw position transducer 27*a* of the lead screw motor and has an output to the velocity command and correction module. The velocity command and correction module outputs the velocity reference to a motor drive unit 42 having an output velocity command to the lead screw motor 26 and an input velocity feedback from the transducer 27*a*.

Likewise the work spindle control module comprises a velocity module 43 having an input to a velocity command and correction module 44 and a position control module 45 having an output to a position comparator and error generator 46. The position comparator and error generator has a further input from the positioned transducer 23 of the work spindle drive motor and has an output to the velocity command and correction module 44. The latter module has an output velocity reference signal to the motor drive unit 47 which has an output providing a velocity command signal to the work spindle motor and an input velocity feedback from the transducer 23.

As each data record is read from the master cam generator, it is transformed to the time domain and the actual positions of the work spindle and ball screw are then sampled and compared to the command positions. Errors will cause the velocity reference commands to be adjusted in order to eliminate the position error on the appropriate axis. The velocity reference command for each axis output to a DC servo driver which causes the motor to rotate at the command velocity. The actual velocity of the motor is compared to the command velocity and an error will cause the command velocity to be adjusted in order to eliminate the error.

The data relating to one complete revolution of the component is held in a master cam array (MCA). the ACU can store multiple arrays relating to different cam forms. The start position of each MCA can be related to a known datum on the work spindle. Therefore the cam form can be indexed through any angle to a revolution equivalent to that representate by one record of the MCA.

The identity of each cam on the component is communicated to the ACU, via its input buffer, by the machine when it is correctly positioned relative to the grinding wheel. This identity is used to select the correct MCA and to index the MCA to the correct angle. The cam identity and index values for a given component are held in component reference array (CRA) in ACU memory.

The ACU provides the following operating modes:

1. Run/job work rotation without displacement;
2. Job work displacement;
3. Set work rotation datum;
4. Set work displacement datum;
5. Synchronised work displacement of rotation;
6. Run/job work rotation with synchronised displacement;
7. Rotate and displace work to datum;
8. Rotate work one revolution with synchronised displacement;
9. Rotate work with constant rotation at speed and synchronised displacement. This option overrides the programmed work rotation speed and adjusts the work displacement velocity accordingly.

The master cam generator (MCG) communicates with the ACU via the input/output buffers. It is programmed to model the cam generating geometry of the machine and converts the master cam follower lift data as specified on the component drawing to a form which is usable by the ACU.

The MCG uses three basic files;

1. Master cam polar co-ordinates file for each cam type, i.e. inlet, exhaust, eccentric.
2. Machine constants file. This contains details of all parameters relating to the generating geometry of the machine.
3. Component reference file. This contains details of the component cams, i.e. displacement, angle, cam type, rotation speed profile.

These files are used to generate the master cam arrays and component reference arrays used by the AVU and are transferred by a communications link.

In order to correct for wheel wear, the wheel radius, held in machine constants file, is decremented and a new MCA generated and transferred to the ACU as required. In the automatic mode, this procedure will be activated by signals from one or other of the systems for determining wheel size as described above. The current MCA held by the MCG will be transferred to the ACU on the signal. On completion of the transfer, the wheel radius will be decremented to the next wheel size and a new MCA will be generated by the MCG and held until the next transfer signal is received.

Each cam profile is ground to the required size in accordance with the programme in the MCG and at the completion of each grinding operation, the work table is indexed by a mechanism not shown to bring the next cam profile along the cam into alignment with the grinding wheel for grinding. Overall control and co-ordination of the various machine operations is obtained by a program controller linking all three microprocessors which control the different specific operations of the machine.

I claim:

1. A profile forming apparatus comprising means for rotatably mounting a workpiece while the profile is to be formed thereon, means for rotating the workpiece at a speed controlled by a predetermined programme, a rotary machine tool for removing stock from a portion of the workpiece held by the mounting means, the machine tool being rotatable about an axis parallel to the axis of rotation of the workpiece, a work table for supporting said mounting means for rocking movement about an axis parallel to the axis of rotation of the workpiece, means to feed the machine tool at a predetermined rate and by a predetermined distance to remove a required amount of stock from the workpiece and drive means for rocking the workpiece mounting means in accordance with the predetermined programme to determine the dimensions and shape of the profile to be machined on the workpiece by the machine tool, wherein the improvement comprises lever means provided on said workpiece mounting means extending transversely to the axis of rocking movement thereof for connection to said drive means, the drive means comprising a high torque low inertia reversible electric drive motor, mounting means on the work table for supporting the drive motor, trunnion means for mounting the drive motor in said motor mounting means to tilt about an axis parallel to the axis of rocking of the workpiece mounting means, the drive motor having a ball screw means output shaft and a nut in which the ball screw means engages and further trunnion means pivotably connected to said lever means to tilt about an axis parallel to the rocking axis of the workpiece mounting means.

2. An apparatus as claimed in claim 1 wherein the predetermined programme for controlling the drive means for the workpiece and the reversible drive means for rocking the work table are contained in a microprocessor system connected to the drive means and the reversible drive means to control the operation thereof.

3. An apparatus as claimed in claim 2 wherein the microprocessor system includes memory means having a first file for storing polar co-ordinate information for each shape to be generated; a second file for apparatus constants relating to the generating geometry of the apparatus and a third file for component velocity information and profile selection from the profiles stored in the first file.

4. An apparatus as claimed in claim 3 and in the case where the component to be machined has a number of profiles spaced along the component and at phased angular relationships with respect to each other, wherein the third file contains information relating to the profile types and angular inter-relationship between the profile types.

5. An apparatus as claimed in claim 3 wherein the microprocessor system includes means for generating information for the three files in accordance with profile or machine information input into the system.

6. An apparatus as claimed in claim 3 wherein the microprocessor system is connected through a control unit to the workpiece drive means and to the reversible drive means for the work table, the control system for the work table drive means comprising velocity control means for the reversible drive to receive velocity/position signals from the microprocessor of the required velocity and position and for detecting the actual position of the drive means to dictate the appropriate velocity to the drive means and means for controlling the velocity of the workpiece drive motor in accordance with the position and velocity of the signals received from the microprocessor and the actual position of the workpiece to dictate the appropriate velocity to the drive motor.

7. An apparatus as claimed in claim 6 wherein the velocity control means for the reversible drive means comprise a velocity command and correction module to receive a velocity signal from the microprocessor and to provide a velocity control signal for the drive means, a position comparator and error generator for receiving a position signal from the microprocessor and an actual position signal from the drive means to provide a further control signal for the velocity command and correction module.

8. An apparatus as claimed in claim 7 wherein the velocity command and correction module is connected to a motor drive unit for giving a velocity command signal to the reversible drive means and having a velocity feedback signal from the reversible drive means, the drive unit having means for comparing the feedback and command signals and for adjusting the command signal to reach the velocity reference signal received from the velocity command and correction module.

9. An apparatus as claimed in claim 6 wherein the control system for the workpiece drive motor comprises a velocity command and correction module for receiving a velocity signal from the microprocessor and providing a velocity reference signal for controlling the drive motor and a position comparator and error generator for receiving a position signal from the microprocessor and for detecting the actual position of the drive motor output to provide a further signal for controlling the velocity command and correction module to adjust the velocity reference signal in accordance with the actual position of the workpiece drive motor output.

10. An apparatus as claimed in claim 9 wherein the velocity command and correction module is connected to a motor drive unit to receive the velocity reference signal from the command and correction module, the drive unit having means for producing a velocity command signal in accordance with the velocity reference signal received and the velocity feedback signal from the motor output for correcting the velocity command signal in accordance with the velocity reference signal received.

11. An apparatus as claimed in claim 1 wherein the motor is a "printed" motor.

12. An apparatus as claimed in claim 1, wherein the machine tool is a power driven grinding wheel.

13. An apparatus as claimed in claim 12 wherein means are provided for detecting changes in grinding wheel size and for altering the programme for control operation of the apparatus accordingly.

14. An apparatus as claimed in claim 12 or claim 13 wherein means are provided for dressing the grinding wheel.

* * * * *